US007086800B2

(12) United States Patent
Major et al.

(10) Patent No.: US 7,086,800 B2
(45) Date of Patent: Aug. 8, 2006

(54) WATER DISPENSER FOR QUILTING

(76) Inventors: Maria B. Major, 128 Maple Leaf La., Shelburne, VT (US) 05482; Michael R. Major, 128 Maple Leaf La., Shelburne, VT (US) 05482

( * ) Notice: Subject to any disclaimer, the term of this patent is extended or adjusted under 35 U.S.C. 154(b) by 302 days.

(21) Appl. No.: 10/808,293

(22) Filed: Mar. 25, 2004

(65) Prior Publication Data

US 2004/0197130 A1 Oct. 7, 2004

Related U.S. Application Data

(60) Provisional application No. 60/459,592, filed on Apr. 2, 2003.

(51) Int. Cl.
*B43M 11/02* (2006.01)

(52) U.S. Cl. ..... 401/219; 401/208

(58) Field of Classification Search ..... 401/208, 401/219, 220, 263

See application file for complete search history.

(56) References Cited

U.S. PATENT DOCUMENTS

| | | | | |
|---|---|---|---|---|
| 1,977,414 A | | 4/1934 | Testa | |
| 2,641,788 A | | 6/1953 | Sudbeaz | |
| 2,721,347 A | * | 10/1955 | Benkowski | 401/219 |
| 2,913,746 A | | 11/1959 | Schaich | |
| 3,920,161 A | * | 11/1975 | Kenzian | 401/208 |
| 5,555,673 A | | 9/1996 | Smith | |
| 6,045,283 A | * | 4/2000 | Velasquez et al. | 401/208 |
| 6,279,188 B1 | | 8/2001 | Barwin et al. | |
| 2002/0090251 A1 | | 7/2002 | Sandbach et al. | |

FOREIGN PATENT DOCUMENTS

| | | |
|---|---|---|
| WO | WO 01/26495 A1 | 4/2001 |

* cited by examiner

*Primary Examiner*—Tuan Nguyen
(74) *Attorney, Agent, or Firm*—Richard C. Litman

(57) ABSTRACT

The water dispenser for quilting of the present invention is a hand tool for dispensing a precise amount of liquid in a line on a seam of a quilt. The dispenser includes a dispensing wheel and a hollow plastic squeezable bottle body having two ends. The first end has two prongs and an aperture disposed between the prongs. The second end has a fill aperture through which liquid is poured into the body; the fill aperture is closed by a screw cap. The wheel is removably attached between the two prongs of the body. The wheel has a channeled center flanked by two ridged sides. The channeled center of the wheel is aligned with the aperture of the body to receive the liquid. The liquid is then dispersed to the ridges of the wheel and dispensed on the seam of the quilt as the wheel rotates.

9 Claims, 2 Drawing Sheets

WATER DISPENSER FOR QUILTING

CROSS-REFERENCE TO RELATED APPLICATION

This application claims the benefit of U.S. Provisional Patent Application Ser. No. 60/459,592, filed Apr. 2, 2003.

BACKGROUND OF THE INVENTION

1. Field of the Invention

The present invention relates to an applicator or dispenser. More particularly, the invention relates to an applicator or dispenser having a liquid retaining body and a dispensing wheel that dispenses the liquid in a precise line as it rolls.

2. Description of Related Art

People who sew for fun or for work understand how the aesthetics of an end product depends upon the accuracy of one's sewing. For example, people who quilt require that the seams between each quilted piece be flat in order to produce an aesthetically pleasing quilt. To obtain flat seams people who quilt apply a hot iron over the seam and sometimes spray water or steam the seam and the quilt to try and obtain the flat seam. However, spraying water or steaming the quilt with water does not permit one to control where the water goes on the quilted pieces. This is a problem faced by many people who quilt in that water dispersed in an uncontrolled manner over certain quilted pieces may cause the pieces to stretch thereby distorting the overall measurement of the quilt once completed. A device is needed that can disperse water on a seam of a garment or a fabric to produce a crisp and professional looking seam when ironed.

Many dispensers or applicators have been developed to dispense liquids such as water or chemicals. U.S. Pat. No. 1,977,414, issued to Testa on Oct. 16, 1934, describes a combination bottle stopper and perfume dispenser. The device will positively dispense perfume in a line in any direction when rubbed with a dispensing roller that is disposed at a top end of the dispenser. U.S. Pat. No. 2,913,746, issued to Schaich on Nov. 24, 1959, describes an improved ball-type of cosmetic applicator. Specifically, the invention provides a retaining filament for a ball applicator, which limits the axial movement of the ball with respect to the container. Because of the filament, the ball only shifts between a dispensing position and a sealing position relative to the container.

U.S. Pat. No. 2,641,788, issued to Sudbeaz on Jun. 16, 1953, describes a combined cap and dispenser for perfume bottles. One embodiment of the dispenser shows a ball disposed in a cap on the dispenser. The cap controls the dispensation of the bottle's contents by the ball.

U.S. Pat. No. 6,179,505, issued to Oder, III et al. on Jan. 30, 2001, describes a leak-tight container and roll-on applicator. The applicator is designed to vent gases built up by pressure within the container and thereby prevent leaks or spills of the product contained within the container. U.S. Pat. No. 6,237,800, issued to Barrett on May 29, 2001, describes a water bottle that can accommodate both a human's drinking needs as well as a pet's drinking needs. The bottle has two drinking portions, one portion has a spout for drinking by the human and the other portion has a roller ball for drinking by the pet.

U.S. Patent Application Publication No. 2002/0090251, published on Jul. 11, 2002, describes an applicator for a fabric treatment composition that is versatile, convenient to carry and easy to apply. The applicator utilizes a nib through which chemicals contained within the applicator is dispensed to remove stains. U.S. Pat. No. 5,555,673, issued to Smith on Sep. 17, 1996, describes a method and an apparatus for applying a liquid on a surface. The apparatus has a valve for dispensing liquid into cellulose material for application of the liquid on an object or surface. Gravity is used to release a portion of liquid through the dispenser into the cellulose material.

None of the above inventions and patents, taken either singly or in combination, is seen to describe the instant invention as claimed. Thus a water dispenser for quilting solving the aforementioned problems is desired.

SUMMARY OF THE INVENTION

The water dispenser for quilting of the present invention is a hand tool for dispensing a precise amount of liquid in a line on a seam of a quilt. The dispenser includes a dispensing wheel and a hollow plastic squeezable bottle body having two ends. The first end has two prongs and an aperture disposed between the prongs. The second end has a fill aperture through which liquid is poured into the body; the fill aperture is closed by a screw cap. The wheel is removably attached between the two prongs of the body. The wheel has a channeled center flanked by two ridged sides. The channeled center of the wheel is aligned with the aperture of the body to receive the liquid. The liquid is then dispersed to the ridges of the wheel and dispensed on the seam of the quilt as the wheel rotates.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
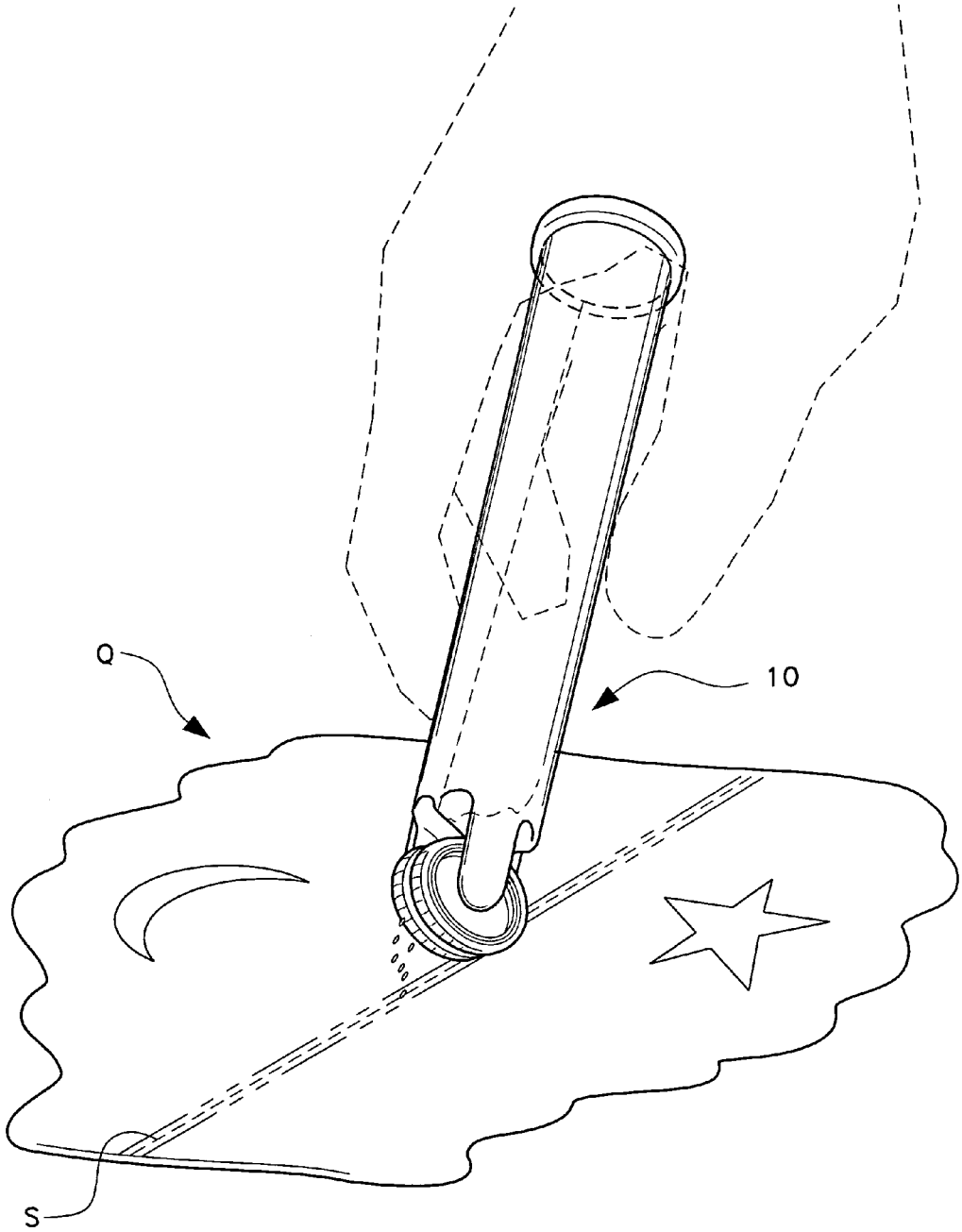
FIG. 1 is an environmental, perspective view of a water dispenser for quilting, according to the present invention.

The present invention is a water dispenser for quilting, designated as 10 in the drawings. As shown in FIG. 1, the dispenser 10 is a hand-held tool used by a user to dispense a liquid such as water on a seam S of a quilt Q or other fabric. The dispenser 10 is approximately 6 inches tall and holds about 4 ounces of water."

Figure 2:
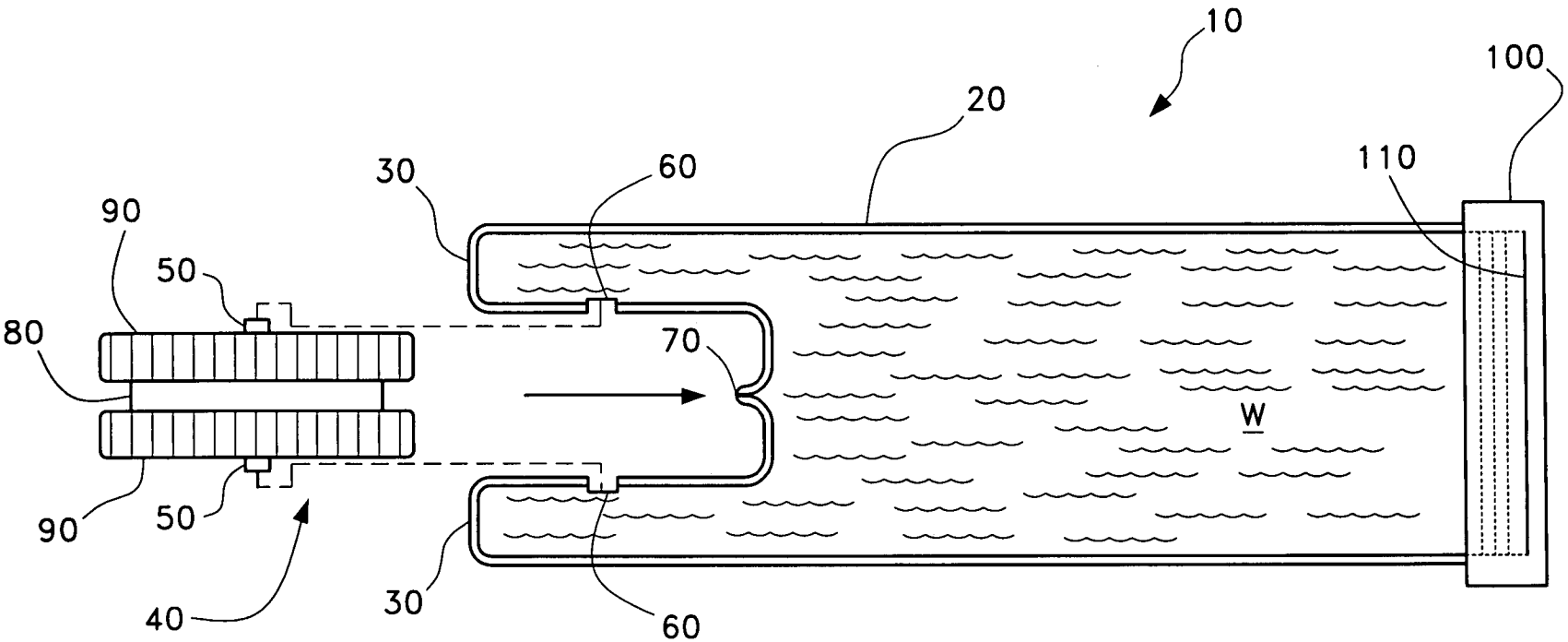
FIG. 2 is an exploded side perspective view of a water dispenser for quilting.

The dispenser 10, shown in detail in FIG. 2, comprises a hollow body 20 and a dispersing wheel 40. The body 20 has two ends. A first end of the body 20 forms a generally "U" shaped cavity where two prongs 30 define each arm of the "U" and a dispensing aperture 70 is disposed between the prongs 30 at the base of the "U". A second end of the body 20 is a fill aperture 110. The body 20 is preferably made of a pliable plastic or other pliable material to enable the user to squeeze the body 20 and force the contents of the body 20 out of the aperture 70, if needed.

The body 20 defines a space within which a liquid such as water W is disposed and retained. The hollow body 20 can hold up to approximately 4 ounces of water W. The water W is put in the body 20 through the fill aperture 110. Once the body 20 is filled, a screw cap 100 is threaded on the second end of the body 20 to close the fill aperture 110 and keep the water W in the body 20. As an optional feature, a measuring line may be marked on the body 20 to indicate the amount of water retained in the body 20.

The water W exits the body 20 through the dispensing aperture 70. The dispensing aperture 70 is disposed opposite the fill aperture 110, at the first end of the body 20 between the two prongs 30. The prongs 30 are integral to the body 20 and have sockets 60 disposed on the inside of each of the two prongs 30. The sockets 60 of the prongs 30 serve to receive and hold the wheel 40.

The wheel 40 is made of plastic material. The wheel 40 is about the size of a dime and about 1/16" wide. The wheel 40 has a channeled center 80 that is flanked by ridged sides 90 and a protruding axle 50 disposed in the center of the wheel 40. The protruding axles 50 disposed on the wheel 40 correspond to the notches 60 on the prongs 30. The axle 50 of the dispensing wheel 40 is snapped into the sockets 60 on the prongs 30 thereby permitting the wheel to rotate about the protruding axles 50. The wheel 40 is removably and rotably attached between the prongs 30 of the body 20.

When the wheel 40 is disposed between the prongs 30 of the body 20 the channeled center 80 of the wheel 40 will be in alignment with the dispensing aperture 70 of the body 20. The water W retained in the body 20 will exit out the dispensing aperture 70 by gravity feed when the dispenser 10 is inverted in a upside down position or by pressure applied to the body 20 of the dispenser 10.

The water W is expelled from the dispensing aperture 70 directly onto the channeled center 80 of the dispersing wheel 40. Upon rolling the wheel 40 on the seam S of the quilt Q, the water W will be delivered to the ridged sides 90 and be evenly dispersed along the plurality of ridges 90 on each side of the channeled center 80. The water dispenser 10 will produce an approximate ½-inch wide path of water W when rolled over the seam S of the quilt Q; the water dispensed from the dispenser 10 will be ¼" from each side of the seam S.

The dispenser 10 is optimally useful for people who quilt. The dispenser 10 allows the user to deposit a controlled amount of water W in a localized area such as the seams S on a quilt Q. It is important to control the amount and flow of water W on the seam S because any amount of water W that is dispersed on the quilted pieces may distort the shape of that quilted piece and consequentially distort the overall shape of the quilt.

Here, the dispenser 10 enables the user to quickly and evenly apply water W to seam S of the quilt Q and then apply a hot iron on the wet seam S to obtain a smooth and crisp looking result. Though the dispenser 10 is ideally suited for people who quilt, the dispenser 10 could be used in other areas of the textile industry.

We claim:

1. A water dispenser for quilting, comprising:

a hollow body having a first end and a second end, said first end having two prongs forming a generally U-shaped that are integral to the body and a dispensing aperture disposed between the two prongs, said second end having a fill aperture; and a dispensing wheel rotatably connected between the prongs of the body having a channeled center and ridged sides that flank the channeled center, the channeled center is in alignment with said dispensing aperture of the body;

whereby a liquid is disposed within the body through the fill aperture and dispensed out of the body by the dispensing aperture onto the channeled center of the wheel and dispersed on a seam of a quilt or a fabric by the wheel as the wheel rotates over the seam.

2. The water dispenser according to claim 1, wherein the dispensing wheel is removably attached to the body between the two prongs.

3. The water dispenser according to claim 1, wherein protruding axles are disposed on the wheel for attaching the wheel between the two prongs and rotatably moving the wheel on the body.

4. The water dispenser according to claim 1, wherein the prongs have notches for receiving the protruding axles of the wheel.

5. The water dispenser according to claim 1, further comprising a screw cap that is dimensioned and configured to cover the fill aperture and seal the second end of the body.

6. The water dispenser according to claim 1, wherein the hollow body is made from plastic.

7. The water dispenser according to claim 1, wherein said hollow body is pliable and can be squeezed to facilitate dispersal of the liquid from the dispensing aperture.

8. The water dispenser according to claim 1, wherein the dispersing wheel is made of plastic.

9. The water dispenser according to claim 1, wherein the U-shaped cavity defined by the two prongs are dimensioned and configured to receive the wheel.

* * * * *